US007262735B2

(12) United States Patent
Noe

(10) Patent No.: US 7,262,735 B2
(45) Date of Patent: Aug. 28, 2007

(54) SNAP-IN ANTENNA ASSEMBLY FOR WIRELESS RADIO CIRCUIT CARD

(75) Inventor: Gary L. Noe, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 153 days.

(21) Appl. No.: 10/999,110

(22) Filed: Nov. 29, 2004

(65) Prior Publication Data

US 2006/0114160 A1 Jun. 1, 2006

(51) Int. Cl.
*H01Q 1/24* (2006.01)

(52) U.S. Cl. ..... 343/702; 343/700 MS

(58) Field of Classification Search ..... 343/700 MS, 343/702, 893; 455/269
See application file for complete search history.

(56) References Cited

U.S. PATENT DOCUMENTS

| | | | | |
|---|---|---|---|---|
| 5,517,387 | A | 5/1996 | Smith | |
| 5,606,732 | A | 2/1997 | Vignone, Sr. | |
| 6,099,329 | A | 8/2000 | Goff et al. | |
| 6,190,182 | B1 | 2/2001 | Liebnow et al. | |
| 6,217,351 | B1 | 4/2001 | Fung et al. | |
| 6,222,505 | B1 | 4/2001 | Endo et al. | |
| 6,266,017 | B1 | 7/2001 | Aldous | |
| 6,295,207 | B1 | 9/2001 | Jones | |
| 6,400,321 | B1 | 6/2002 | Fenwick | |
| 6,535,172 | B2 * | 3/2003 | Hirabayashi | 343/725 |
| 6,579,108 | B1 | 6/2003 | Goff | |
| 6,624,639 | B2 | 9/2003 | Schiffer | |
| 6,751,476 | B2 | 6/2004 | Masaki et al. | |
| 2003/0060239 | A1 | 3/2003 | Masaki et al. | |
| 2004/0027299 | A1 | 2/2004 | Sjoblom et al. | |
| 2004/0070543 | A1 * | 4/2004 | Masaki | 343/702 |
| 2004/0075612 | A1 | 4/2004 | Spiropoulos | |

* cited by examiner

*Primary Examiner*—Thuy V. Tran
*Assistant Examiner*—Dieu Hien T Duong
(74) *Attorney, Agent, or Firm*—Todd T. Taylor, Esq.

(57) ABSTRACT

An electronic wireless communication system includes an electronic device with a plug-in circuit card. The plug-in circuit card includes a wireless radio circuit and at least one on-board coaxial connector coupled with the wireless radio circuit. An antenna card includes at least one antenna and at least one on-board coaxial connector. At least one of the on-board coaxial connectors on the antenna card is coupled with a corresponding antenna. Each on-board coaxial connector on the antenna card is also coupled with a mating on-board coaxial connector on the plug-in circuit card.

29 Claims, 2 Drawing Sheets

SNAP-IN ANTENNA ASSEMBLY FOR WIRELESS RADIO CIRCUIT CARD

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND OF THE INVENTION

1. Field of the Invention

The present invention relates to systems and methods for wireless communication between electronic devices, and, more particularly, to antennas used with such wireless communication systems.

2. Description of the Related Art

Wireless ethernet, (or Wi-Fi, or IEEE 802.11), is becoming a mainstream technology. The integration of an antenna/radio solution within a notebook PC involves the ability to build a wireless radio directly on the main board or on a mini-PCI card, both of which are considered "integrated" within the case of the notebook personal computer (PC). Currently, many notebook PCs integrate IEEE 802.11 technology via a mini-PCI card which contains the wireless radio and Media Access Controller (MAC) electronics. The mini-PCI card is a portable, small card that is integrated or plugged directly onto the motherboard via a PCI interface socket located in the notebook PC. An upgrade using a mini-PCI card is not as easily performed as those wireless systems located on a PCMCIA card, but the risk of damage and loss of components are greatly reduced with the internal mini-PCI card system.

A mini-PCI card includes two connectors on the card (i.e., Hirose U.FL) which are available to connect two pre-installed cabled antennas to the card. The antennas are not internally integrated into these mini-PCI radios. Even though these commodity radio units are certified for various world geographies, re-certification is necessary when external antennas are attached.

If a printer or other electronic device makes use of the cost/performance/reliability of these commodity mini-PCI radios to enable wireless connectivity, each product requires recertification of the radio section for each product, even if the radio/antenna system is identical to the previously certified system. Again, this is due to the variation of external antenna geometry which is considered a new configuration.

What is needed in the art is an antenna for use with a mini-PCI radio card which is quickly and easily attached to the mini-PCI radio card, provides good performance, and does not require re-certification when used in different electronic devices.

SUMMARY OF THE INVENTION

The present invention provides an antenna card with at least one antenna and a pair of coaxial connectors which electrically and mechanically connect with a pair of mating coaxial connectors on a mini-PCI wireless radio card.

The invention comprises, in one form thereof, an electronic wireless communication system having an electronic device with a plug-in circuit card. The plug-in circuit card includes a wireless radio circuit and at least one on-board coaxial connector coupled with the wireless radio circuit. An antenna card includes at least one antenna and at least one on-board coaxial connector. At least one on-board coaxial connector on the antenna card is coupled with a corresponding antenna. Each on-board coaxial connector on the antenna card is also coupled with a mating on-board coaxial connector on the plug-in circuit card.

The invention comprises, in another form thereof, an antenna assembly for use with a plug-in circuit card including a wireless radio circuit and a pair of on-board coaxial connectors, at least one of the on-board coaxial connectors being coupled with the wireless radio circuit. The antenna assembly includes an antenna card having at least one antenna and a pair of on-board coaxial connectors. At least one on-board coaxial connector on the antenna card is coupled with a corresponding antenna. Each on-board coaxial connector on the antenna card is couplable with a mating on-board coaxial connector on the plug-in circuit card.

The invention comprises, in yet another form thereof, a method of connecting an antenna to a plug-in circuit card having a wireless radio circuit and a pair of on-board coaxial connectors, at least one on-board coaxial connector being coupled with the wireless radio circuit. The method includes the steps of: providing an antenna card including at least one antenna and a pair of on-board coaxial connectors, at least one of the on-board coaxial connectors coupled with a corresponding antenna; and connecting the pair of on-board coaxial connectors on the antenna card with the pair of on-board coaxial connectors on the plug-in circuit card.

It is expected that the present invention of the plug-in circuit card, such as a mini-PCI wireless radio card, and the attached antenna card can be certified as an integrated unit, regardless of the type of electronic device in which the integrated unit is used (e.g., computer or printer). Further, the pair of quick-connect coaxial connectors allow the antenna card to be electrically and mechanically connected to the plug-in circuit card at a fixed geometric orientation. Still further, one or both of the quick-connect coaxial connectors can be coupled with a corresponding antenna, such as a main and/or auxiliary antenna.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
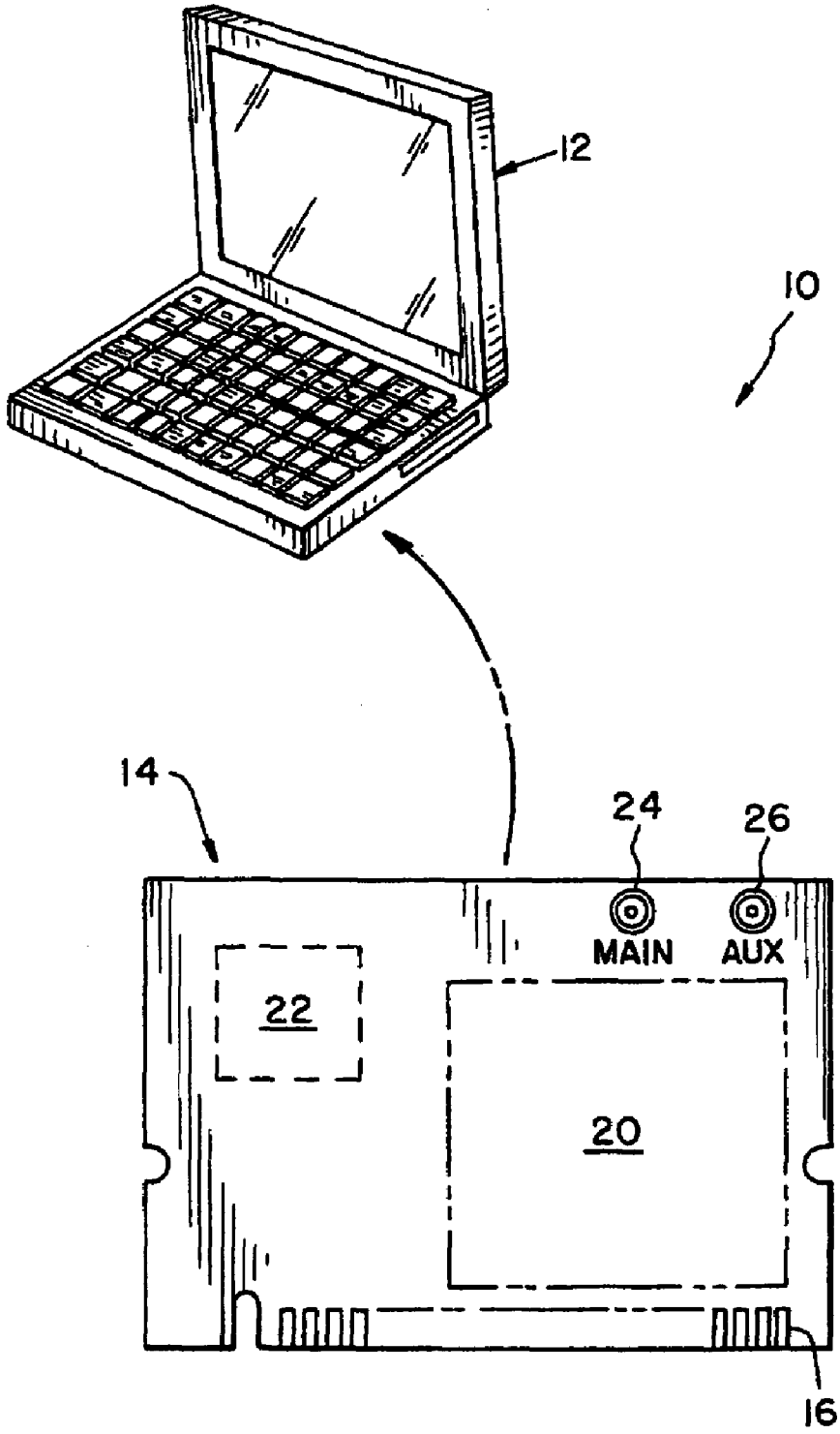
FIG. 1 is a schematic illustration of an electronic wireless communication system which may be used with an embodiment of an antenna card of the present invention.

Referring now to the drawings, and more particularly to FIG. 1, there is shown an embodiment of an electronic wireless communication system 10 of the present invention, which generally is in the form of a notebook PC 12 which transmits and receives data in a wireless manner with other electronic wireless communication systems, such as a network hub, other computers, a printer, etc. The present invention as described hereinafter is shown as being utilized within notebook PC 12; however, it is to be understood that the present invention may be utilized in any type of suitable electronic wireless communication system as will be appreciated hereinafter. Notebook PC 12 includes an input device in the form of a keyboard and a visual display. Notebook PC 12 also typically includes a number of expansion slots for receiving different types of expansion circuit cards. In the embodiment shown, notebook PC 12 includes a PCI interface socket associated with one of the expansion slots for receiving a mini-PCI card 14.

Mini-PCI card 14 is in the form of a wireless Ethernet card conforming to the IEEE standard 802.11 radio card. Mini-PCI card 14 includes an edge connector 16 which connects with the PCI interface socket within notebook PC 12. The various terminals on edge connector 16 are electrically connected with various functional circuits shown schematically in FIG. 1, including wireless radio circuit 20 and diversity circuit 22. Mini-PCI card 14 may also include other functional hardware circuits and software to carry out the wireless communication.

Wireless radio circuit 20 is electrically coupled with a main antenna connector 24 and an auxiliary antenna connector 26. In the embodiment shown, main antenna connector 24 and auxiliary antenna connector 26 are in the form of Hirose U. FL coaxial connectors having a same sex configuration. Main antenna connector 24 and auxiliary antenna connector 26 are provided to couple with a main and auxiliary antenna, respectively.

Diversity circuit 22 is optional and allows selective use of one or both of main antenna connector 24 and auxiliary antenna connector 26. Diversity wireless systems or radios generally provide better performance than similar non-diversity systems. A diversity system is desirable because it effectively combats the most common problem with wireless equipment, namely, signal dropouts or multipath, when RF signals arrive at a location via different transmission paths, consisting of a combination of direct and reflected signals. Under these conditions, the output can be noisy, lost, or undecipherable. These problems generally occur in closed areas where metal objects are present, but may also exist in other environments. Diversity systems are able to avoid signal dropouts because they have two antennas and two receiver channels. Special circuits in the receiver select the signal from the antenna and receiver channel with the best signal. Because the chances that there will be a simultaneous signal dropout at both antennas 24 and 26 are extremely low, diversity systems avoid signal dropouts. Diversity systems can also improve the useful operating range for wireless systems. This is because, even when there are no actual signal dropouts, the amount of signal available or strength of signal available at long ranges can be reduced. This can cause the wireless system to briefly lose the wireless signal well before the transmitter is truly out of range. With a diversity system, complete signal loss is unlikely and the operating range is extended.

Exemplary diversity wireless protocols include the IEEE 802.11 RF wireless standards: 802.11 HR, 802.11b, and 802.11 @ 5 GHz standards. Other diversity wireless protocols include HiperLan, HiperLan II, and OpenAir wireless protocols. If a mini-PCI card is used without a diversity circuit, exemplary non-diversity wireless protocols include the Bluetooth protocol, HomeRF protocol, and SWAP protocol.

Main antenna connector 24 and auxiliary antenna connector 26 are intended to be connected with coaxial cables attached to external antennas. The main antenna is necessary for proper operation. If both the main and auxiliary external antennas are used, diversity circuit 22 is enable and compensates for multipath signal drop outs. If the main and auxiliary antennas are spaced apart at least one wavelength in distance, diversity is ensured.

Figure 2:
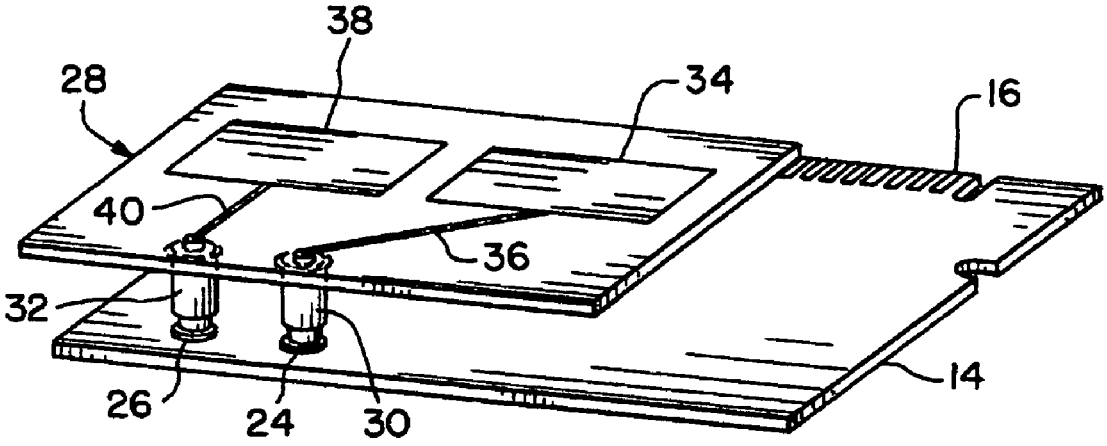
FIG. 2 is a perspective view showing interconnection between the mini-PCI card shown in FIG. 1 and an embodiment of an antenna card of the present invention.

Referring now to FIG. 2, an antenna assembly 28 of the present invention which may be used with electronic wireless communication system 10 shown in FIG. 1 will be described in greater detail. Antenna assembly 28 is generally in the form of an antenna card which is electrically and mechanically coupled with mini-PCI card 14 at a fixed geometric orientation. More particularly, antenna card 28 is in the form of a circuit board having a pair of same sex configuration Hirose U. FL coaxial connectors 30 and 32 which snap lock together with main antenna connector 24 and auxiliary antenna connector 26 on mini-PCI card 14. Coaxial connector 30 is electrically connected with a main antenna 34 via an electrical trace 36 printed on antenna card 28. Main antenna 34 is a patch antenna which is printed on antenna card 28 with a suitable geometric configuration. Coaxial connector 32 is electrically connected with an auxiliary antenna 38 via electrical trace 40 which is printed on antenna card 28. The geometric configuration of auxiliary antenna 38, as well as spacing between auxiliary antenna 38 and main antenna 34 is selected depending upon the particular application. For example, auxiliary antenna 38 and main antenna 34 are both shown as patch antennas which are printed on antenna card 28, but may also be configured as discrete antennas which are soldered onto antenna card 28.

During installation, antenna card 28 is oriented relative to mini-PCI card 14 such that coaxial connectors 30 and 32 align with main antenna connector 24 and auxiliary antenna connector 26, respectively. The mating coaxial connectors are then pressed together to mechanically couple and geometrically fix antenna card 28 relative to mini-PCI card 14. Moreover, the pair of mated coaxial connectors 30, 32 and 24, 26 electrically couple main antenna 34 and auxiliary antenna 38 with wireless radio circuit 20.

Antenna card 28 advantageously transforms mini-PCI card 14 into a complete system that can be certified for worldwide use, regardless of the end application in which it is installed. By geometrically fixing antenna card 28 relative to mini-PCI card 14, this integrated unit is considered as a self-contained unit which requires only a single certification. The certified system including the integrated mini-PCI card 14 and antenna card 28 can be installed in a variety of different products without the burden and cost of recertification.

Main antenna connector 24 and auxiliary antenna connector 26 are typically maintained with a standard spacing therebetween. This allows antenna card 28 to be used with multiple different makes of mini-PCI radio cards. Antenna card 28 therefore does not require a special platform for use.

Figure 3:
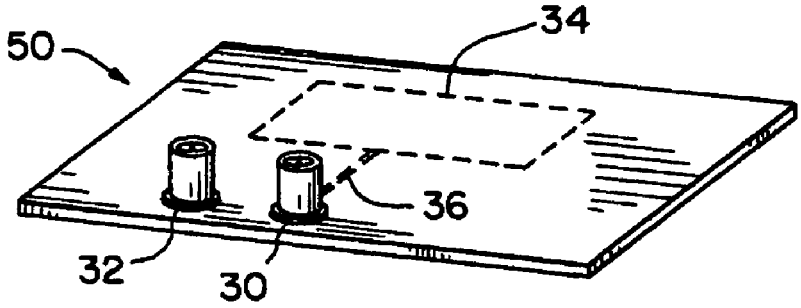
FIG. 3 is a perspective view of another embodiment of an antenna card of the present invention.

Referring now to FIG. 3, another embodiment of an antenna card 50 of the present invention will be described. Antenna card 50 is similar to antenna card 28, in that it includes a pair of coaxial connectors 30 and 32 which are configured and spaced to mate with main antenna connector 24 and auxiliary antenna connector 26 on mini-PCI card 14. Also, coaxial connector 30 is coupled with main antenna 34 via electrical trace 36. However, coaxial connector 32 is not coupled with an auxiliary antenna, and provides only a mechanical connection with auxiliary antenna connector 26 on mini-PCI card 14. Coaxial connector 32 thus fixes the geometrical orientation of antenna card 50 relative to mini-PCI card 14.

It will also be appreciated that an antenna card having a single coaxial connector for mechanically and electrically connecting with main antenna connector 24 on mini-PCI card 14 is possible. Of course, such an antenna card would have only a single main antenna. If only a single coaxial connector is used and that connector is not capable of fixing the orientation of the antenna card with respect to the mini-PC card, then it is necessary to provide another type of mechanical locating feature and interconnection between antenna card 28 and mini-PCI card 14. In other words, means must be provided to fix the geometric or spatial orientation between the antenna card and mini-PCI card 14.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electronic wireless communication system, comprising:

an electronic device, including a plug-in circuit card having a wireless radio circuit and at least one on-board coaxial connector coupled with said wireless radio circuit; and an antenna card including at least one antenna and at least one on-board coaxial connector, at least one said on-board coaxial connector coupled with a corresponding said antenna, each said on-board coaxial connector on said antenna card also coupled with a mating said on-board coaxial connector on said plug-in circuit card, said antenna card having a fixed geometric and spatial orientation relative to said plug-in circuit card.

2. The electronic wireless communication system of claim 1, wherein each of said plug-in circuit card and said antenna card includes a pair of on-board coaxial connectors.

3. The electronic wireless communication system of claim 2, wherein said antenna card includes a main antenna and an auxiliary antenna respectively coupled with said pair of on-board coaxial connectors on said antenna card.

4. The electronic wireless communication system of claim 3, wherein said plug-in circuit card includes a diversity circuit for selective use of said main antenna and said auxiliary antenna.

5. The electronic wireless communication system of claim 2, wherein said antenna card includes a single antenna coupled with a respective one of said pair of on-board coaxial connectors on said antenna card.

6. The electronic wireless communication system of claim 5, wherein an other of said pair of on-board coaxial connectors on said antenna card provides a mechanical connection only with a corresponding one of said pair of on-board coaxial connectors on said plug-in circuit card.

7. The electronic wireless communication system of claim 2, wherein said pair of mating coaxial connectors on each of said antenna card and said plug-in circuit card geometrically and spatially fix the orientation said antenna card relative to said plug-in circuit card.

8. The electronic wireless communication system of claim 2, wherein said pair of on-board coaxial connectors on said plug-in circuit card are at a known, predetermined distance from each other.

9. The electronic wireless communication system of claim 2, wherein each of said pair of on-board coaxial connectors on said plug-in circuit card are of a same configuration.

10. The electronic wireless communication system of claim 2, wherein each of said pair of on-board coaxial connectors on said plug-in circuit card are snap-type coaxial connectors.

11. The electronic wireless communication system of claim 1, wherein said plug-in circuit card comprises a wireless ethernet card.

12. The electronic wireless communication system of claim 11, wherein said wireless ethernet card comprises a standard 802.11 radio card.

13. The electronic wireless communication system of claim 1, wherein said electronic device comprises one of a printer and a computer.

14. The electronic wireless communication system of claim 13, wherein said computer comprises one of a laptop computer and a personal computer.

15. An antenna assembly for use with a plug-in circuit card including a wireless radio circuit and a pair of on-board coaxial connectors, at least one of the on-board coaxial connectors being coupled with the wireless radio circuit, said antenna assembly comprising:

an antenna card including at least one antenna and a pair of on-board coaxial connectors, at least one said on-board coaxial connector on said antenna card being coupled with a corresponding said antenna, each said on-board coaxial connector on the antenna card being couplable with a mating on-board coaxial connector on the plug-in circuit card, said antenna card having a fixed geometric and spatial orientation relative to said plug-in circuit card.

16. The antenna assembly of claim 15, wherein said antenna card includes a main antenna and an auxiliary antenna respectively coupled with said pair of on-board coaxial connectors on said antenna card.

17. The antenna assembly of claim 15, wherein said antenna card includes a single antenna coupled with a respective one of said pair of on-board coaxial connectors on said antenna card.

18. The antenna assembly of claim 15, wherein each of said pair of on-board coaxial connectors on said antenna card are of a same configuration.

19. The antenna assembly of claim 15, wherein each of said pair of on-board coaxial connectors on said antenna card are snap-type coaxial connectors.

20. An antenna assembly for use with a plug-in circuit card including a wireless radio circuit and at least one on-board coaxial connector being coupled with the wireless radio circuit, said antenna assembly comprising:

an antenna card including at least one antenna and at least one on-board coaxial connector being coupled with a corresponding said antenna, said at least one on-board coaxial connector on the antenna card being couplable mating with the at least one on-board coaxial connector on the plug-in circuit card with the antenna card being in fixed geometric and spatial orientation with respect to the plug-in circuit card.

21. The antenna assembly of claim 20, wherein said antenna card includes a main antenna and an auxiliary antenna respectively coupled with a pair of on-board coaxial connectors on said antenna card.

22. The antenna assembly of claim 21, wherein said antenna card includes a single antenna coupled with a respective one of said pair of on-board coaxial connectors on said antenna card.

23. The antenna assembly of claim 21, wherein each of said pair of on-board coaxial connectors on said antenna card are of a same configuration.

24. The antenna assembly of claim 21, wherein each of said pair of on-board coaxial connectors on said antenna card are snap-type coaxial connectors.

25. The antenna assembly of claim 20 further including a means for mechanically fixing the spatial orientation between the plug-in circuit card and the antenna card.

26. A method of connecting an antenna to a plug-in circuit card including a wireless radio circuit and a pair of on-board coaxial connectors, at least one of the on-board coaxial connectors being coupled with the wireless radio circuit, said method comprising the steps of:

providing an antenna card including at least one antenna and a pair of on-board coaxial connectors, at least one of said on-board coaxial connectors coupled with a corresponding said antenna; and connecting said pair of on-board coaxial connectors on said antenna card with said pair of on-board coaxial connectors on said plug-in circuit card, said connecting step fixing the geometric and spatial orientation of said antenna card relative to said plug-in circuit card.

27. The method of claim 26, wherein said antenna card includes a main antenna and an auxiliary antenna respectively coupled with said pair of on-board coaxial connectors on said antenna card, said connecting step including the substep of electrically connecting each of said main antenna and said auxiliary antenna with the wireless radio circuit on said plug-in circuit card.

28. The method of claim 26, wherein said antenna card includes a single antenna coupled with a respective one of said pair of on-board coaxial connectors on said antenna card, said connecting step including the substep of electrically connecting said single antenna with the wireless radio circuit on said plug-in circuit card.

29. The method of claim 26, wherein each of said pair of on-board coaxial connectors on said antenna card are of a same configuration.

* * * * *